United States Patent [19]

Bennett et al.

[11] Patent Number: 4,779,500

[45] Date of Patent: Oct. 25, 1988

[54] AUTOMATIC END CUTTER

[75] Inventors: Lester C. Bennett, Tonawanda; John H. Buscher, Amherst; Andrzej Nalecz, Williamsville, all of N.Y.

[73] Assignee: Eastman Machine Company, Buffalo, N.Y.

[21] Appl. No.: 909,497

[22] Filed: Sep. 19, 1986

[51] Int. Cl.[4] ..... B26D 1/18; B26D 1/20

[52] U.S. Cl. ..... 83/208; 83/482; 83/487; 83/508.1; 83/614; 83/649; 83/174

[58] Field of Search ..... 83/508.1, 208, 369, 83/649, 216, 559, 614, 71, 174

[56] References Cited

U.S. PATENT DOCUMENTS

| | | | |
|---|---|---|---|
| 3,686,991 | 8/1972 | Fujimoto | 83/487 X |
| 3,733,951 | 5/1973 | Fujimoto | 83/487 X |
| 4,117,753 | 10/1978 | Friddle et al. | 83/614 X |
| 4,553,328 | 11/1985 | Buscher | 269/224 X |
| 4,555,967 | 12/1985 | Jumel | 83/649 X |
| 4,691,605 | 9/1987 | Vanetik et al. | 83/485 X |

*Primary Examiner*—Donald R. Schran
*Attorney, Agent, or Firm*—Christel, Bean & Linihan

[57] ABSTRACT

Apparatus for cutting sheet material such as cloth as the material lies on a supporting surface having opposite sides comprising an elongated track adapted to extend across the supporting surface between the sides, the track having an operative surface over which the sheet material lies during cutting thereof, and a cutter operatively associated with the track for movement in opposite directions along the track for cutting the material. The apparatus further includes supporting structures on opposite ends of the track and associated with the opposite sides of the surface, the supporting structures including mechanisms for raising and lowering the track relative to the supporting surface, a drive operatively coupled to the cutter and to the raising and lowering mechanisms for moving the cutter along the track for cutting the material and for raising and lowering the track and a control operatively connected to the drive for causing the drive to move the cutter along the track for cutting the material and thereafter causing the drive to raise and lower the track. The control also includes provision for limiting the maximum length of travel of the cutter along the track as well as controlling the speed of travel thereof, allowing sharpening of the cutter and controlling the height to which the track is raised.

25 Claims, 8 Drawing Sheets

Fig. 5.
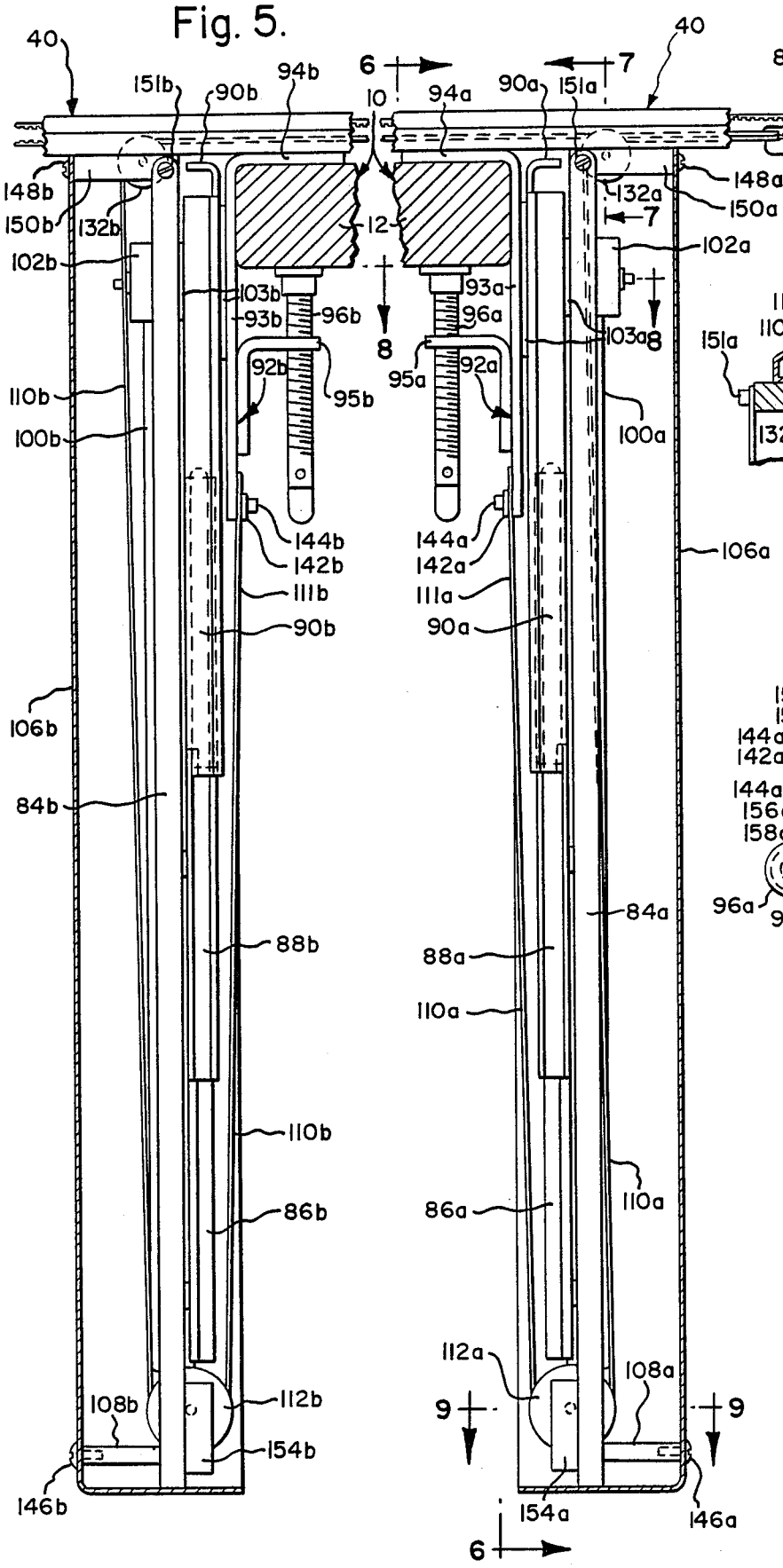
Fig. 7.
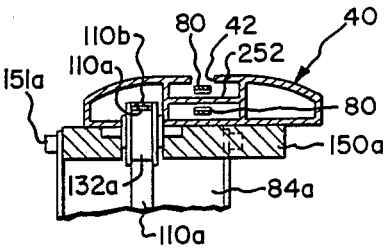
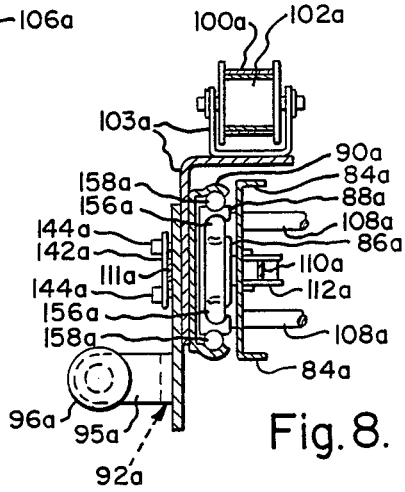
Fig. 8.
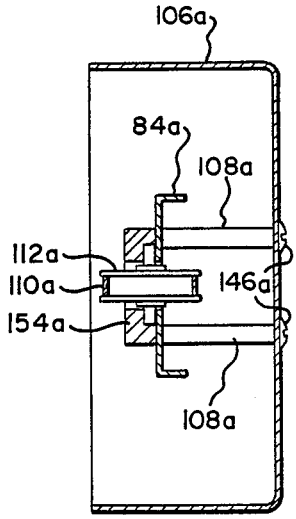
Fig. 9.

Fig. 11.
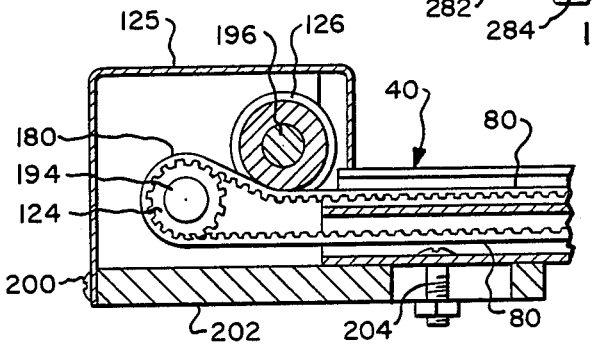
Fig. 15.
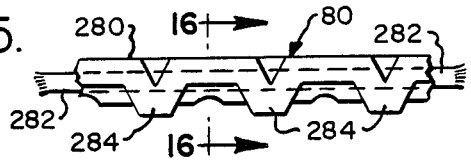
Fig. 16.
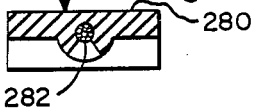
Fig. 17.
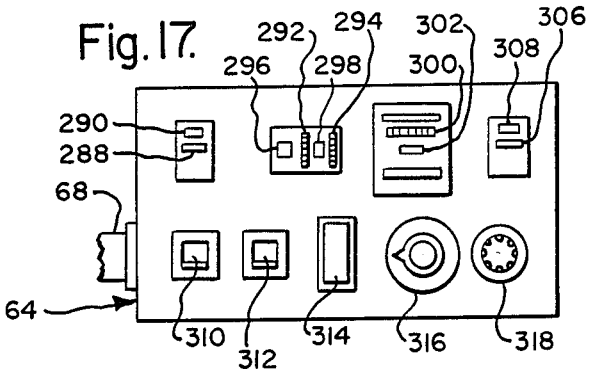
Fig. 12.
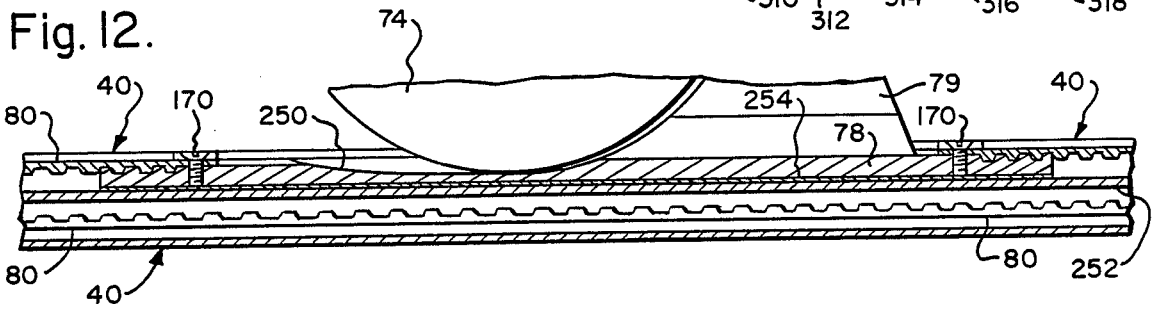
Fig. 14.
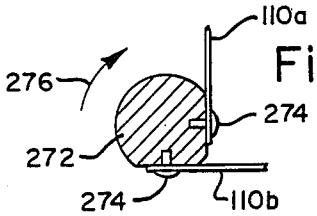
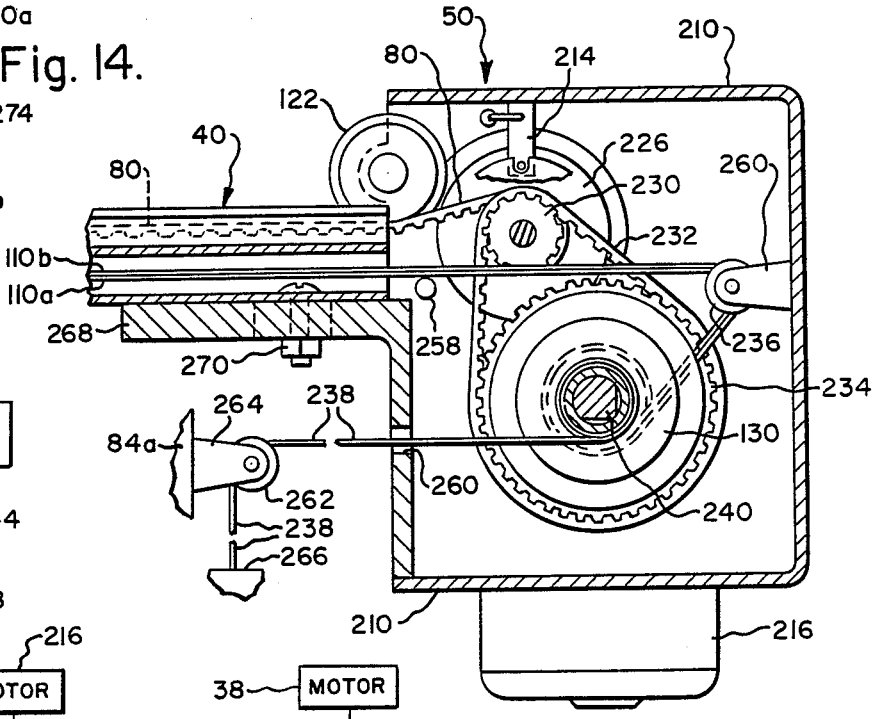
Fig. 18.
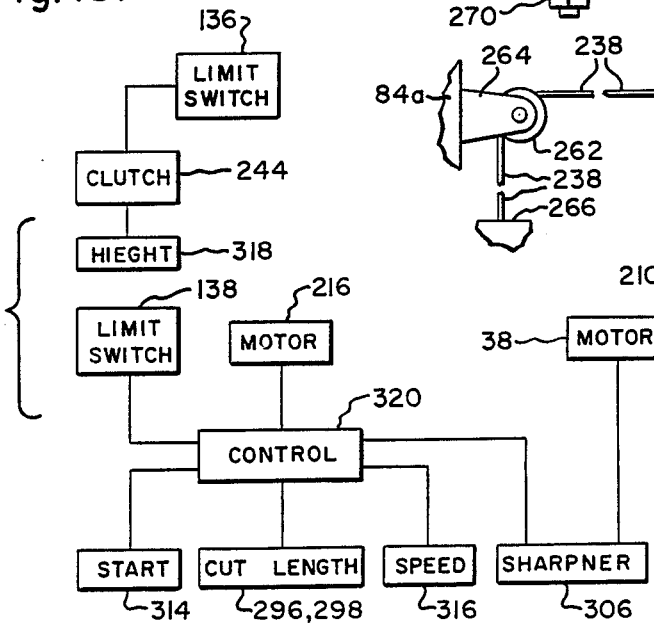
Fig. 13.

Fig. 24.
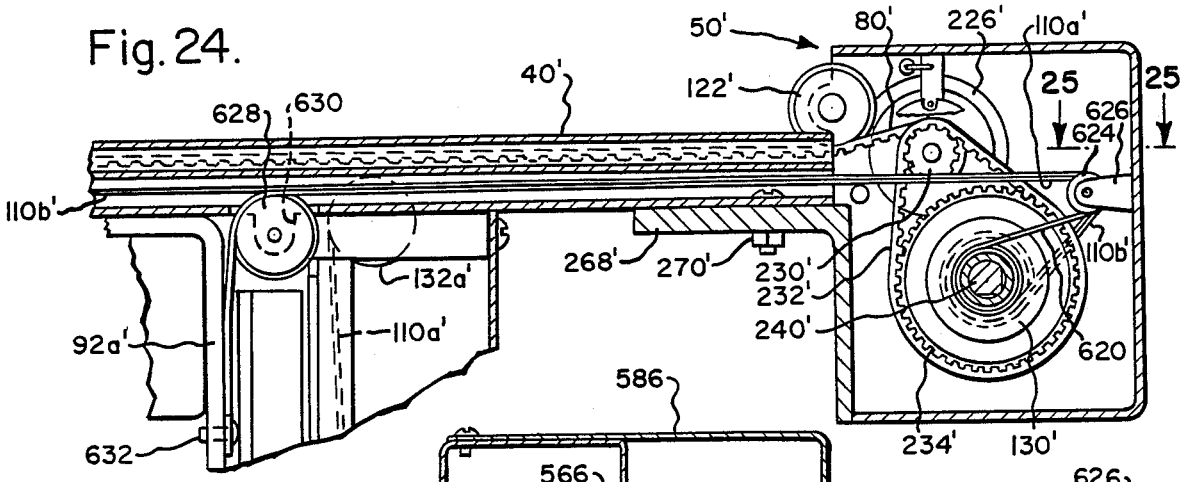
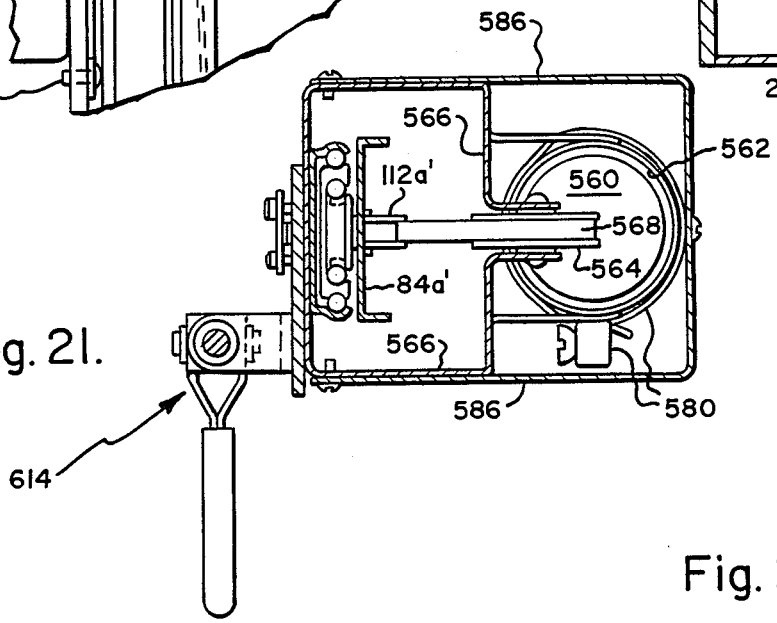
Fig. 21.
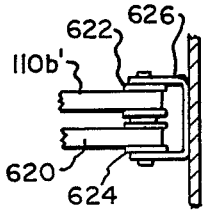
Fig. 25.
Fig. 23.
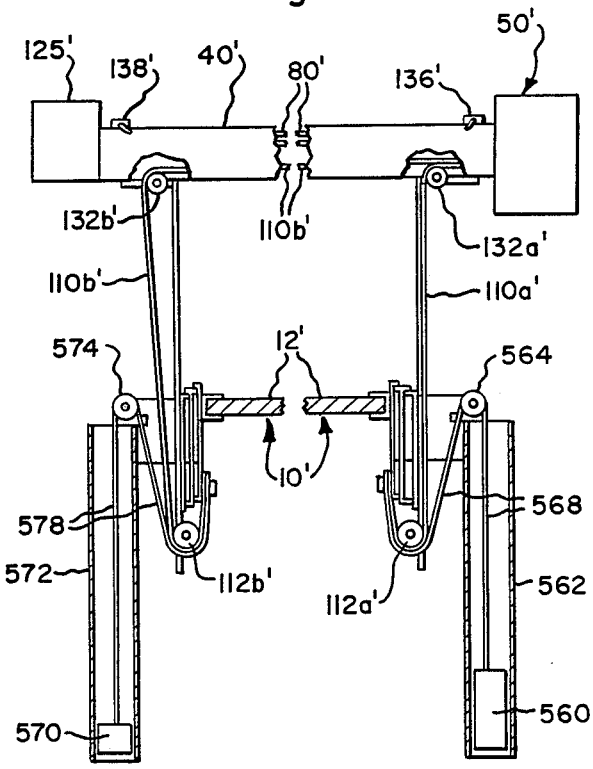
Fig. 22.
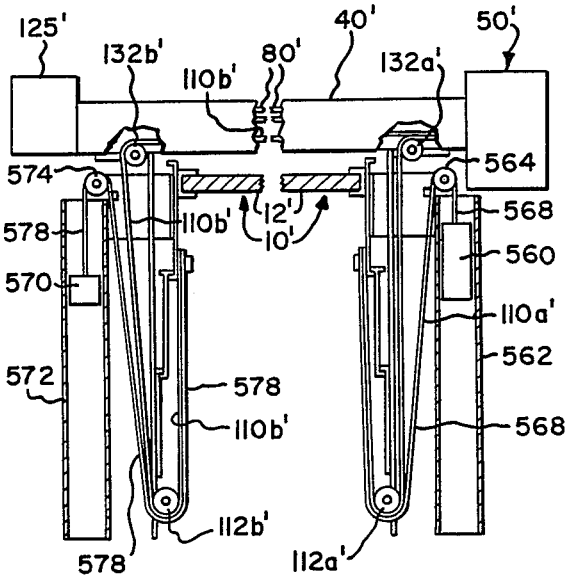

AUTOMATIC END CUTTER

BACKGROUND OF THE INVENTION

This invention relates to apparatus for cutting sheet material such as cloth in endwise sections, and more particularly to a new and improved end cutter having automatic operation.

In cutting special orders and short lays of sheet material such as cloth, the sheet material is drawn from a supply such as a roll along a cutting table, the desired length is cut, the next section is drawn along the table and cut, and this procedure is repeated until the required number of pieces of material have been cut to the same measurement and stacked up. The cutting machine is guided in a direction across the table by a track member which is in the form of an elongated bar having a guide slot therealong. As each piece is cut, in order to accommodate stacking of the pieces, it is necessary to lift the track member and then return it into contact with the corresponding edge of the stack.

Heretofore such cutting apparatus was operated manually. The cutting machine was moved along the track by use of an extended handle, and the track was raised and lowered by operation of a balanced lifting mechanism for augmenting manually applied force. It would be highly desirable to provide cutting apparatus of the foregoing type characterized by automatic operation. In particular, movement of the cutting machine along the track would be automatic and self-powered or driven and motorized raising and lowering of the track would be automatic and not in response to application of manual force. Such automatic apparatus desirable would also have provision for control of such operational parameters as speed and length of travel of the cutting machine along the track and maximum height to which the track is raised.

SUMMARY OF THE INVENTION

It is, therefore, a primary object of this invention to provide a new and improved apparatus for cutting sheet material such as cloth in endwise sections.

It is a more particular object of this invention to provide such apparatus of the type wherein a cutting machine is guided along a track over which the sheet material lays and the track is raised and lowered after each cut for stacking which apparatus is characterized by automatic operation.

It is a further object of this invention to provide such automatic cutting apparatus having control of various operational parameters.

It is a further object of this invention to provide such automatic cutting apparatus which is simple in construction, efficient in operation and convenient to maintain.

The present invention provides apparatus for cutting sheet material such as cloth as the material lies on a supporting surface having opposite sides comprising elongated track means adapted to extend across the supporting surface between the sides, the track means having an operative surface over which the sheet material lies during cutting thereof, and cutting means operatively associated with the track for movement in opposite directions along the track for cutting the material. The apparatus further includes supporting means on opposite ends of the track means and associated with the opposite sides of the surface, the supporting means including means for raising and lowering the track relative to the supporting surface, drive means operatively coupled to the cutting means and to the raising and lowering means for moving the cutting means along the track for cutting the material and for raising and lowering the track means and control means operatively connected to the drive means for causing the drive means to move the cutting means along the track for cutting the material and thereafter causing the drive means to raise and lower the track means. The control means also includes provision for limiting the maximum length of travel of the cutting means along the track as well as controlling the speed of travel thereof, allowing sharpening of the cutting means and controlling the height to which the track means is raised.

The foregoing and additional advantages and characterizing features of the present invention will become clearly apparent upon a reading of the unsuing detailed description wherein:

BRIEF DESCRIPTION OF THE DRAWING FIGURES

FIG. 5 is an enlarged sectional view taken about on line 5—5 in FIG. 1;

FIG. 7 is a sectional view taken about on line 7—7 in FIG. 5;

FIG. 8 is a sectional view taken about on line 8—8 in FIG. 5;

FIG. 9 is a sectional view taken about on line 9—9 in FIG. 5;

FIG. 11 is a sectional view taken about on line 11—11 in FIG. 10;

FIG. 12 is a sectional view taken about on line 12—12 in FIG. 10;

FIG. 13 is a fragmentary cross-sectional view of the drive means of FIG. 10;

FIG. 14 is a fragmentary sectional view of a component of the drive means of FIG. 13;

FIG. 15 is a fragmentary elevational view of the cutter drive belt in the apparatus of the present invention;

FIG. 16 is a cross-sectional view of the belt of FIG. 15;

FIG. 17 is a plan view of the panel face of the control means of the apparatus of the present invention;

FIG. 18 is a block diagram of the control and drive system of the apparatus of the present invention;

FIG. 21 is a sectional view taken about on line 21—21 in FIG. 20;

FIG. 22 is a diagrammatic view illustrating the apparatus of FIG. 20 with the track in a lowered or rest position;

FIG. 23 is a diagrammatic view similar to FIG. 22 but with the track in a raised position;

FIG. 24 is a fragmentary cross-sectional view of the drive means of this embodiment of the present invention;

FIG. 25 is a sectional view taken about on line 25—25 in FIG. 24.

DETAILED DESCRIPTION OF THE ILLUSTRATED EMBODIMENT

Figure 1:
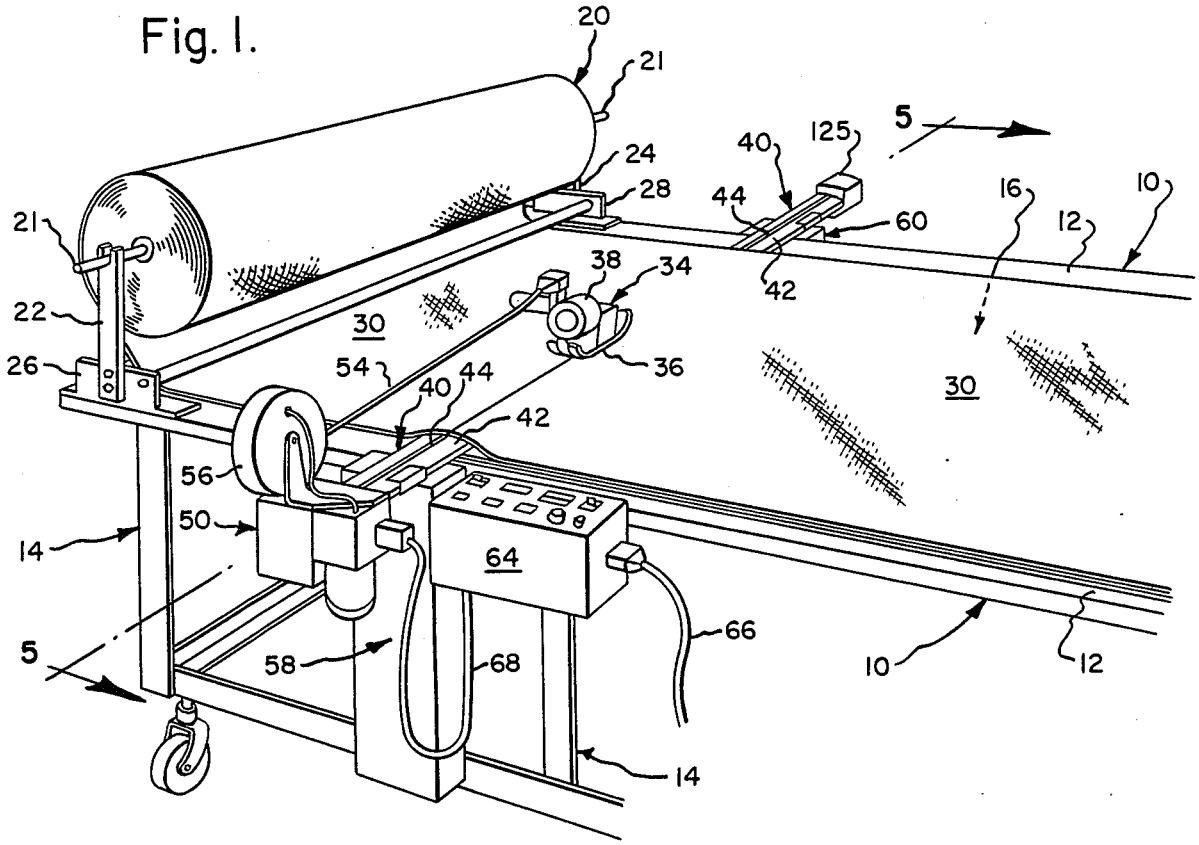
FIG. 1 is a perspective view of apparatus for cutting sheet material such as cloth according to the present invention.

FIG. 1 shows the cutting apparatus of the present invention as it would appear in use with a cutting table, feed roll supply and an arrangement for cutting cloth or similar sheet material in special orders or short lays of material. A conventional cutting room table is generally designated 10 and has a planar supporting surface 12, usually disposed substantially in a horizontal plane and having a pair of substantially parallel opposite sides 14 and 16 extending along the length thereof. The cloth or similar sheet material is supplied and fed from various suitable arrangements, and by way of illustration a conventional supply roll 20 wound on a rod or shaft 21 is rotatably supported by a pair of spaced apart upstanding arms 22 and 24 fixed to brackets 26 and 28, respectively, near one end of table 10. The supply roll 20 is shown in FIG. 1 with a portion 30 of the cloth or sheet material being fed onto surface 12. For cutting the cloth material 30 there is shown cutting means generally designated 34 in the form of a round knife machine comprising a presser foot 36, motor 38 and blade (not shown). Cutter 34 is commercially available from Eastman Machine Company under the designation Falcon End Cutter. The components of cutter 34 and mounting thereof together will be described in detail presently. The cutter 34 is guided across the supporting surface or table 10 for cutting cloth 30 by guide means in the form of an elongated bar or track 40 having a hollow interior and which extends across table 10 substantially perpendicular to the longitudinal axis of the table, i.e. perpendicular to side 14, 16. Track 40 has an operative surface 42 over which the sheet material or cloth lies and a slot 44 extending longitudinally thereof for guiding travel of the blade of cutter 34.

The cutting apparatus further comprises drive means generally designated 50 located at one end of guide means 40 and means (not shown in FIG. 1) for drivingly coupling cutting means 34 to drive means 50 for moving cutter 34 in opposite directions along the track 40. In particular, cutter 34 is moved first in one direction, i.e. the forward direction away from drive means 50 as viewed in FIG. 1, across the entire width of sheet 30 for cutting the same and then is moved in the opposite direction to a return position near drive means 50 in preparation for the next cut. As will be described in detail presently, drive means 50 includes a motor, gear and pulley arrangement for operating a belt connected to cutter 34. Electrical power for operating cutter 34 is supplied by a conductor 54 connected at one end to cutter 34 by a suitable electrical connector and wound up or otherwise stored in a reel 56. There is also provided supporting means generally designated 58,60 at opposite ends of track 40 and associated with table 10 adjacent the opposite sides 14,16. As will be described in detail presently, each supporting means includes an arrangement to raise and lower the track 40 relative to the surface 12 of table 10 in a controlled manner, the raising and lowering advantageously being done automatically in response to operation of drive means 50 through a suitable coupling means to arrangements in the supporting means 58,60. The apparatus also includes control means 64 for controlling operation of drive means 50 and cutter 34. Electrical power is supplied to control means 64 by a line 66, and control and power signals are supplied to drive means 50 by leads included in a conductor 68.

Briefly, the apparatus of FIG. 1 operates in the following manner. The apparatus is fully automatic and cuts in a precise and fast manner to reduce labor time and save production expense. The only work required by the human operator is pulling material from roll 20 and operating switches on control means 64. The latter includes switches to turn the apparatus on and off and to start the cutting operation. It also includes indicators and controls for counting the plies cut, controlling raising and lower of track 40, and varying the speed of the machine, all of which will be described. Thus, the operator simply grasps the end of the portion 30 of cloth to draw it from supply reel 20 along supporting surface 12 and over the track 40. Then he operates the switch on control means 64 which starts a cycle causing drive means 50 to move cutter 34 first in a forward direction along track 40 to cut the cloth 30 and then return for the next cut during which return the control causes drive means 50 to operate arrangements in supporting means 58,60 to raise and then lower bar 40 for stacking of the cut section of cloth 30. The machine remains in a rest condition waiting for the next cut. The operator then simply pulls more material from roll 20 over track 40 and operates the same switch on control means 64 resulting in an identical cutting cycle including raising and lowering of track 40. The foregoing is repeated for the required number of cut sections of cloth, the cut sections being stacked on table 10 adjacent track 40. For a description of cutting and stacking in manually operated apparatus, reference may be made to U.S. Pat. No. 4,553,328 issued Nov. 19, 1985 entitled "Guided Lifting Apparatus", the disclosure of which is hereby incorporated by reference.

Figure 4:
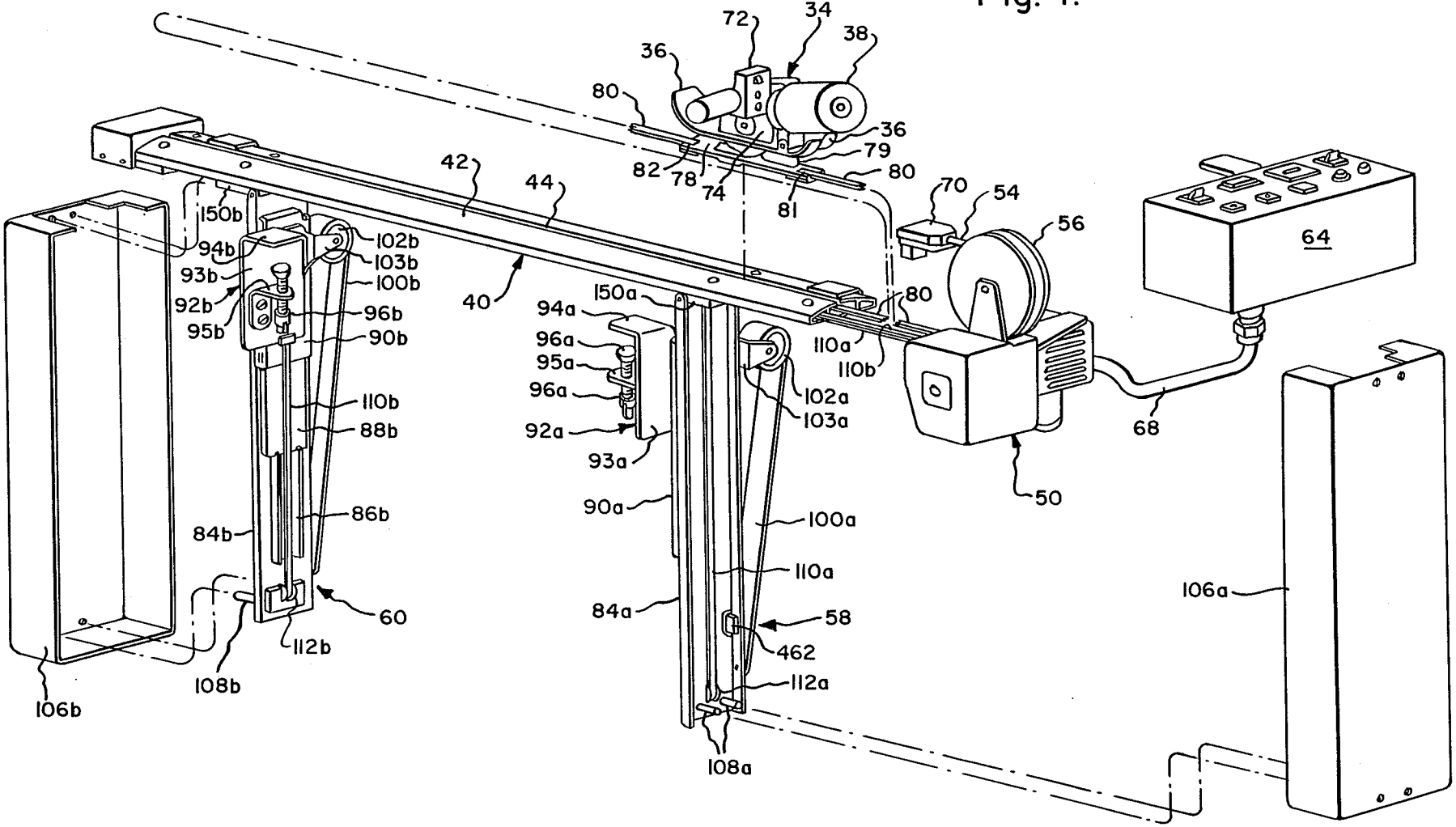
FIG. 4 is an exploded perspective view of the apparatus of the present invention.
Figure 6:
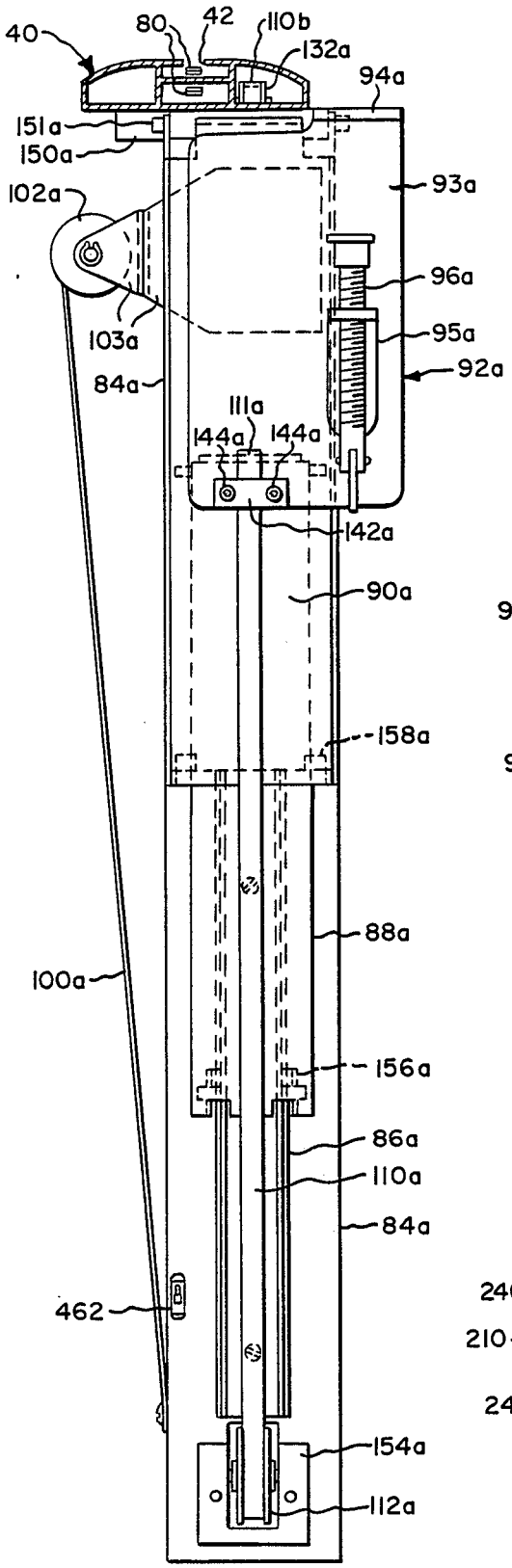
FIG. 6 is a sectional view taken about on line 6—6 in FIG. 5.

The exploded view of FIG. 4 shows the apparatus of the present invention in further detail. Conductor 54 is provided with a connector plug component 70 at one end thereof which mates with a receptacle component 72 on cutter 34 adjacent motor 38 for supplying electrical power thereto. A round cutting blade 74 is rotated by motor 38 and extends through a slot or elongated opening in presser foot 36, the latter component travelling along above the bar 40 and the cloth 30 being cut. Blade 74 extends into and along slot 44 of track 40. Cutter 34 also is provided with a baseplate 78 depending therefrom in spaced relation to presser foot 36 and supported by a bracket 79. Base 78 has a recess in the upper surface thereof to accommodate blade 74 as will be described. Base 78 is disposed generally parallel to foot 36 and is located in the hollow interior of track 40 beneath surface 42 and travels therealong during movement of cutter 34 along bar 40 as will be described.

As shown in FIG. 4, there is provided coupling means in the form of a belt 80 operatively connected to drive means 50 and cutter 34 for moving cutter 34 along track 40 in response to operation of drive means 50. Belt 80 can be in the form of a plastic chain as will be described and is connected to base 78. In particular, belt 80 has one end 81 connected to one end of base 78, the other end 82 connected to the opposite end of base 78. The belt is trained around a pulley (not shown in FIG. 4) at the far end of track 40, i.e. remote from drive means 50, and at the opposite end engages a gear wheel (not shown) in drive means 50, the latter being accomplished by teeth (not shown in FIG. 4) provided along the length of belt 80 in a manner which will be described. Belt 80 extends along within track 40 in a central part of the hollow interior thereof offset from the slot 44.

The two supporting means 58,60 also are shown in further detail in FIG. 4. The supporting means 58 and 60 are identical in structure and operation, and for convenience in description the components thereof will be designated by the same reference numerals with a and b letters respectively. Each of the supporting means 58 and 60 includes coupling means connected to track 40 and to table 10 and operatively connected to drive means 50 for providing controlled raising and lowering of track 40 relative to table 10 in response to operation of drive means 50. In particular, each coupling means comprises a frame, for example the elongated channel members **84*a*,84*b* depending from track 40 at spaced locations therealong and adjacent the opposite ends 14,16, respectively, of table 10. The supporting means 58,60 are disposed substantially perpendicular to the plane of track 40. Each channel member 84a,84b is fixed at one end, i.e. the upper end as viewed in FIG. 4, to track 40** in a manner which.

Each coupling means further comprises an arrangement or mechanism of variable or changeable length, in particular an arrangement of telescoping slide members such as the members **86*b*,88*b*,90*b* shown in FIG. 4 associated with frame 84*b*. An identical arrangement of telescoping slide members (not shown) is associated with frame 84*a*. The telescoping members are generally in the form of elongated channel members which slidable fit one within the other and are guided for relative movement by internal bearings in the manner of a drawer slide as will be described in detail presently. The slide member at one end of the arrangement, i.e. the lower slide 86*b*, is fixed at the outer end thereof to the frame, i.e. frame 84b. The slide member at the opposite end of the arrangement, i.e. the upper slide 90*b*, is fixed to a clamp or bracket generally designated 92*b* for connection to table 12. In particular, clamp 92*b* is generally in the form of a C having a web or base 93*b*, an upper flange 94*b* for engaging the upper surface 12 of table 10 adjacent the edge along side 16, and a lower flange 95*b* provided with an adjustment screw 96*b* therein for adjustable clamping to the lower or underneath surface of table 10. An identical arrangement including clamp 92*a* and components is provided on frame 84*a* as shown in FIG. 4 for connection to table 10 adjacent side 14**.

The coupling means further comprises biasing means connected between the frame and slides. In particular, there is provided at least one constant force or constant rate spring **100*b*. Spring 100*b*, which can be of the Negater type, is fixed at one end to frame 84b adjacent the lower end thereof as viewed in FIG. 4 and wound in a roll 102*b* connected by a bracket 103*b* to clamp 92*b*. If necessary another identical spring can be provided along the opposite edge of frame 84*b* and connected in an identical manner. Identical biasing means in the form of Negater spring 100*a* is connected between frame 84*a* and the associated transfer slide. Likewise, another identical spring can be provided along the opposite edge of frame 84*a* if necessary. The springs 100*a*,100*b* provide a uniform counteracting force to the weight of bar 40 and cutter 34 regardless of the height or distance through which it is lifted. The respective supporting means 58,60 are contained within corresponding housings 106*a*,106*b* fixed at the lower ends thereof to frames 84*a*,84*b* by screws extending through spaces 108*a*,108*b* and fixed at the upper ends thereof to track 40**.

There is also provided coupling means in the form of a pair of belts **110*a*,110*b* each operatively coupled to a corresponding one of the supporting means 58,60 respectively, and each operatively connected to drive means 50 for raising the supporting means 58,60, simultaneously relative to table 10 in response to operation of drive means 50. In particular, each belt 110*a*,110*b* is connected at one end to a wheel or pulley (not shown) drivingly connected to drive means 50 in a manner which will be described. The two belts 110*a*,110*b* are superimposed one on top of the other for a portion of the length thereof extending from drive means 50, and the belts enter bar 40 and extend along within the hollow interior thereof offset from the belt 80. Belt 110*a* extends around a pulley (not shown in FIG. 4) rotatably connected in the upper end of supporting means 58 and the belt extends downwardly along the outer surface of frame 84*a* as viewed in FIG. 4 and is trained around a pulley 112*a* rotatably connected to the lower end of frame 84*a*. The belt 110*a* then extends upwardly along the opposite surface of frame 84*a* and the slides whereupon it is fastened at the end thereof to bracket 92*a*. Belt 110*b* extends alone further along within track 40 and, in a similar manner, extends around a pulley (not shown in FIG. 4) rotatably connected in the upper end of supporting means 60, and the belt 110*b* extends downwardly along the outer surface of frame 84 and is trained around a pulley 112*b* rotatably connected to the lower end of frame 84*b*. The belt 110*b* then extends upwardly along the inner or opposite surface of frame 84*b* and the slides 86*b*,88*b* and 90*b* as seen in FIG. 4 whereupon it is fastened at the end thereof to bracket 92*b***.

Figure 2:
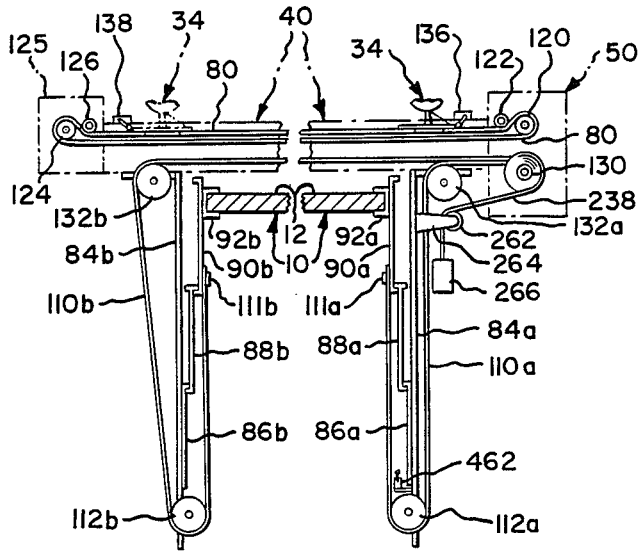
FIG. 2 is a diagrammatic view illustrating the apparatus of the present invention with the track in a lowered or rest position.
Figure 3:
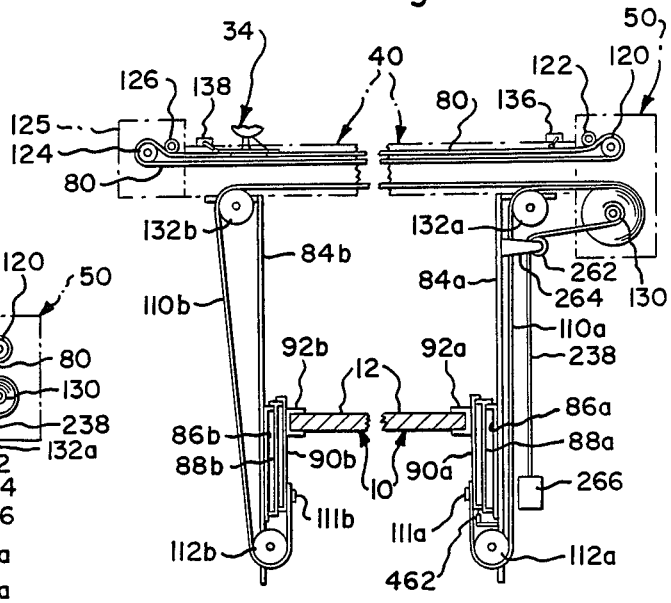
FIG. 3 is a diagrammatic view similar to FIG. 2 but with the track in a raised position.

The raising of track 40 and support means 58,60 relative to table 10 by operation of drive means 50 and belts **110*a*, 110*b* is illustrated in the diagrammatic views of FIGS. 2 and 3. FIG. 2 shows track 40 in the lowermost position closest to the top surface 12 of table 10. This is the normal position of track 40 during rest and during operation and forward travel of cutter 34. As shown in FIG. 2, belt 80 is trained around a gear or toothed wheel 120 of drive means 50, the teeth (not shown) along belt 80 meshing with the teeth of wheel 120. An idler pulley or wheel 122 is located near wheel 120 and contacts the smooth outer surface of belt 80. Belt 80 also is trained around a gear or toothed wheel 124 rotatably mounted in a compartment 125 at the end of bar 40, and an idler pulley or wheel 126 is located near wheel 124 and contacts the smooth outer surface of belt 80**.

As shown in FIG. 2, belts **110*a*,110*b* are fixed at one end to and wound around a wheel or pulley 130 of drive means 50. Belt 110*a* extends around a wheel or pulley 132*a* rotatably mounted in the upper end of supporting means 58 and then downwardly along frame 84*a* and around pulley 112*a* and then upwardly along the opposite side of frame 84*a* where it is secured at the end 110*a* thereof to slide 90*a*. Belt 110*b* extends alone further along track 40 and then around the wheel or pulley 132*b* rotatably mounted in the upper end of supporting means 60. Belt 110***b* then extends downwardly along frame 84*b* and around pulley 112*b* and then upwardly along the opposite side of frame 84*b* where it is secured at the end 111*b* thereof to slide 90b.

FIG. 2 shows the apparatus in the lowermost position, ie. prior to its raised position relative to table 10. In this position, the maximum amount of the length of belts 110*a*,110*b* extends along the frames 84*a*,84*b*. Track 40 is in a position closest to surface 12 of table 10. The solid line representation of cutter 34 shows its location at the beginning of travel along bar 40 and across table 12, this position of cutter 34 being sensed by a limit switch 136. Cutter 34 is represented in broken lines in FIG. 2 at the end of forward travel along bar 40 across table 10 where it engages a limit switch 138. FIG. 3 shows the apparatus in a raised position where track 40, supporting means 58, 60 and drive means 50 are elevated relative to table surface 12. A significant portion of the lengths of belts 110*a*,110*b* is wound around wheel or pulley 130 of drive means 50 as shown in FIG. 3. Cutter 34 is shown at the end of forward travel where it engages limit switch 138 and is about to begin its return toward drive means 50.

FIGS. 5–9 illustrate in further detail the arrangement of supporting means 58,60, track 40 and table 10. The manner in which belts 110*a* and 110*b* extend along within bar 40 and are trained around the upper pulleys 132*a* and 132*b* and around the lower pulleys 112*a* and 112*b* is shown along with fastening of the belt ends 111*a* and 111*b* to frames 84*a* and 84*b* by strips 142*a* and 142*b* and fasteners 144*a* and 144*b*, respectively. The lower ends of housings 106*a* and 106*b* are joined to frames 84*a* and 84*b* by screws 146*a* and 146*b* extending through spacers 108*a*,108*b*. Similarly, the upper ends of housings 106*a* and 106*b* as viewed in FIG. 5 are joined to frames 84*a* and 84*b* by screws 148*a* and 148*b* extending through brackets 150*a* and 150*b*, respectively. Brackets 105*a*,150*b* in turn are fixed to the underside of track 40 and frames 84*a* and 84*b* are connected to brackets 150*a* and 150*b* by screws 151*a* and 151*b*. Pulleys 112*a* and 112*b* adjacent the lower ends of frames 84*a* and 84*b*, respectively, are rotatably mounted to brackets 154*a* and 154*b*, respectively, which in turn are secured to frames 84*a* and 84*b* as shown in FIG. 9. As shown in FIG. 8, ball bearings 156*a* are located between the outer surface of slide 86*a* and the inner surface of slide 88*a*, and ball bearings 158*a* are located between the outer surface of slide 88*a* and the inner surface of slide 90*a*. An identical arrangement of ball bearings (not shown) is provided between slides 86*b* and 88*b* and between slides 88*b* and 90*b*. The bearings can be of a lubricious graphite material.

Figure 10:
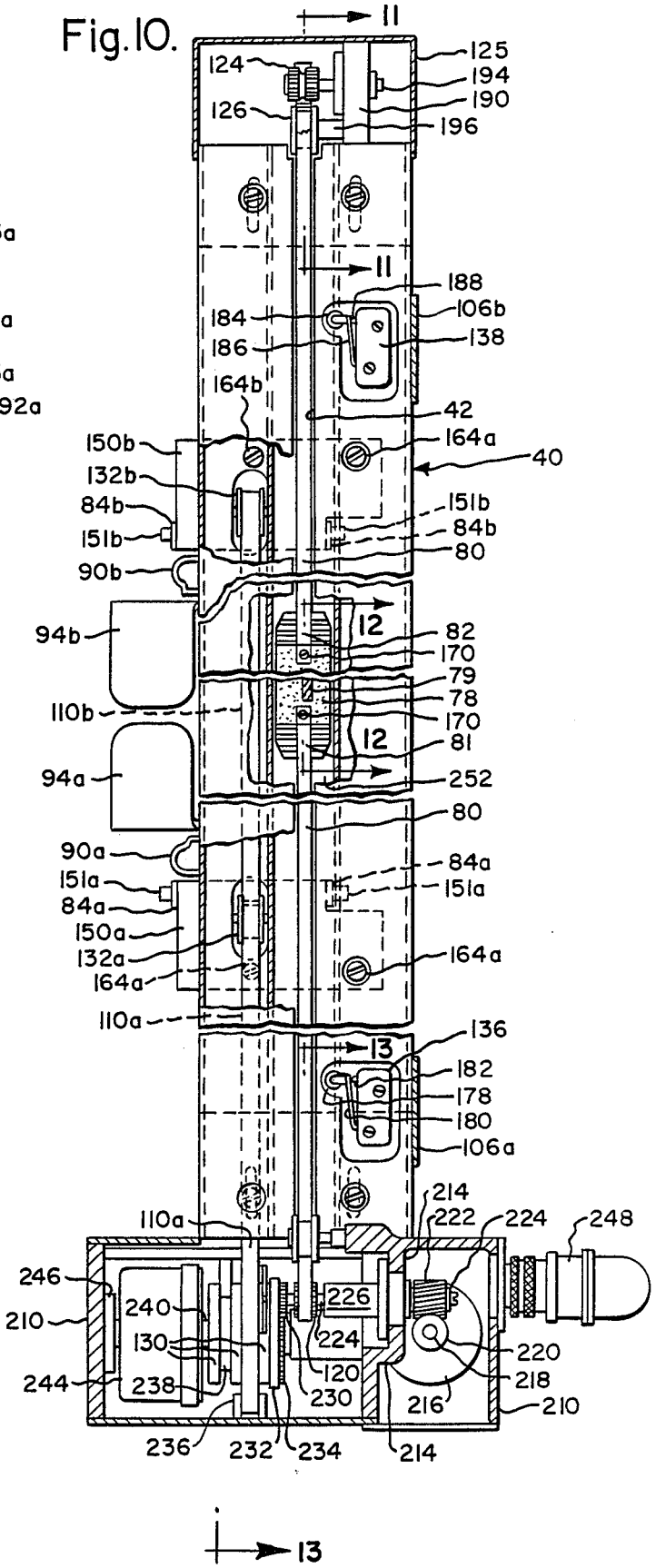
FIG. 10 is a fragmentary plan view, partly in section and with parts broken away, of the guide track and device means of the apparatus of the present invention.

FIGS. 10 and 11 illustrate in further detail the arrangement of components within and in relation to track 40 and the components of drive means 50. As shown in FIG. 10, frame 84*a* is connected to bracket 150*a* by screws 151*a*, and bracket 150*a* is fixed to the underside of bar 40 by fasteners 164*a*. Similarly, frame 84*b* is connected to a bracket 150*b* by screws 151*b*, and bracket 150*b* is fixed to the underside of bar 40 by fasteners 164*b*. The ends 81 and 82 of belt 80 are fastened to cutter base 78 by screws 170.

Limit switch 136 includes a roller 178 rotatably connected to the end of a switch arm 180 normally spaced from a switch contact 182. When cutter 34 engages roller 178, switch arm 180 engages contact 182 to complete a circuit signalling the arrival of cutter 34 at this end of bar 40. Similarly, limit switch 138 includes a roller 184 rotatably connected to the end of a switch arm 186 normally spaced from a switch contact 188. When cutter 34 engages roller 184, switch arm 186 engages contact 188 to complete a circuit signalling the arrival of cutter 34 at the opposite end of bar 40. At this end of bar 40, within housing 125, there is a bracket 190 fixed to the inner surface of housing 106*b*. Gear 124 is mounted on a shaft 194 rotatably connected to bracket 190, and pulley 126 is mounted on a shaft 196 rotatably connected to bracket 190. The arrangement is contained within housing 125 which, as shown in FIG. 11, is fixed by fasteners 200 to a bracket 202 mounted by fasteners 204 to the end of bar 40.

As shown in FIG. 10, drive means 50 includes a hollow rectangular housing 210 provided with an interior wall 214 supporting various drive components. A motor 216 carried by housing 210 has an output shaft 218 on which is mounted a worm gear 220. A helical gear 222 which meshes with worm 220 is fixed on one end of the shaft 224 rotatably supported in a bushing 226 supported in the housing wall. A shaft 224 extends beyond bushing 226 and has the gear or toothed wheel 120 fixed thereon around which belt 80 is trained and a second gear or tooth wheel 230 fixed thereon and spaced from gear 120. A drive belt 232 meshes with gear 230 and with a third gear or toothed wheel 234 fixed to or integral with the pulley 130 on which belts 110*a*,110*b* are wound. Belts extend around an idler 236 suitably mounted on the inner wall of housing prior to pulley 130. Pulley 130 is a double pulley, having one section for belts 110*a*,110*b* and an adjacent section on which is wound a belt 238 extending out from housing 210 and connected to a weight (not shown in FIG. 10) for tensioning pulley 130 as will be described. Pulley 130, in turn, is mounted on a shaft 240 extending from one end of a magnetic clutch 244, the opposite end of which is mounted through a bracket 246 to housing 210 so as to be supported thereby. Electrical line 68 (not shown in FIG. 10) is connected to drive means 50 by an electrical connector 248.

FIG. 12 shows in further detail the arrangement of blade 74, base 78 and bracket for extension 79 along with the connection to belt 80 and the cooperative relationship with track 40. An arcuate recess 250 is provided in the upper surface of base 78 to accommodate blade 74. Base 78 slides along an interior surface member 252 of track 40 located below slot 44 extending along the length of track 40 in a plane parallel to the longitudinal axis of track 40. The surface of base 78 contacting member 252 is provided with a layer or sheet of anti-friction material 254, secured to base 78 by adhesive or the like. By way of example, a material of sheet 254 found to perform satisfactorily is commercially available under the name Turcite.

FIG. 13 shows in further detail the components of drive means 50, and belts 110b and 110a are supported and guided over a pin or shaft 258 rotatably mounted in housing 210. Idler 236 is rotatably connected to a bracket 260 fixed to the inner surface of housing 210. Belt 238 extends from pulley 130 through an opening 260 in the wall of housing 210 and around an idler 262 rotatably connected to a bracket 264 fixed to frame 84a. The end of belt 238 is connected to a weight 266 for tensioning pulley 130. In particular, during return or lowering of track 40 from the elevated position of FIG. 3, the belts 11*a*,110*b* must be rewound on pulley 130 to prepare for the next cycle. Weight 266 applies tension to pulley 130 to insure proper rewinding of belts 110*a*,110*b* on pulley 130. Housing 210 is connected to track 40 by an integral extension or bracket 268 and secured by an appropriate fastener 270. FIG. 14 illustrates the fastening of the end of belts 110*a*,110*b* to the hub or central portion 272 of pulley 130 by fasteners 274. Pulley 130 rotates in the direction of arrow 276 to wind the belts thereon.

FIGS. 15 and 16 show belt 80 in further detail. The belt is in the form of a plastic chain and includes a solid body portion 280 which is rectangular in cross section as shown in FIG. 16. A reinforcing cable or line 282 is embedded in body 280 and extends along the entire length of belt 80. Belt 80 is provided with teeth 284 at spaced intervals therealong for meshing with the teeth of gear wheels 120 and 124 at opposite ends of track 40.

FIG. 17 illustrates in further detail control means 64 and the various control functions provided thereby. There is provided a main power ON/OFF switch 288 which activates main electrical power to all circuits, and an indicator lamp 290 also is included to signal when the power is activated. The control means further comprises a length of cut control comprising a pair of dials 292 and 294 and associated indicators 296 and 298, respectively, to set the length of travel of cutter 34 to minimize wasted time and maximize productivity. Dial 292 sets the distance in feet which is read on indicator 296 and dial 294 sets the distance in inches which is red on indicator 298. The settings on dials 292,294 are converted to inputs to counters of the control circuit associated with motor 216 to control the amount of forward movement imparted through belt 80 to cutter 34 in a manner which will be described. A counter 300 automatically records the number of plies cut and includes a push button 302 for resetting the counter to zero. The control means 64 further comprises a sharpener control in the form of an ON/OFF switch 306. Placing switch 306 in the ON position allows knife motor 38 to operate without operating motor 216 and thus keeping cutter 34 stationary on track 40. Sharpening is provided by the operator manually pressing a button on the side of cutter 34 while knife blade 74 is rotating to urge a sharpening element (not shown) against the blade cutting edge. An indicator lamp 308 signals that switch 306 is ON.

The control means 64 also includes a first circuit breaker 310 for protecting motor 38 of cutter 34 and a second circuit breaker 302 for protecting motor 216 of drive means 50. A start switch 314 when depressed manually begins the operating cycle of the cutting apparatus which includes causing cutter 34 to operate and travel a predetermined length along track 40, either the maximum as set by limit switch 138 or the distance set by dials 282,284, and then return to a home position near the end of bar 40 adjacent drive means 50. During the return, clutch 244 is engaged to drive pulley 130 to cause raising and lowering of track 40. Control means 64 further includes a cutting speed control in the form of knob 316 to vary the speed of travel of cutter 34 along track 40. Knob 306 is connected to the wiper arm of a potentiometer (not shown) which in turn is connected to the control of motor 216 to control the speed of movement of belt 80. A lift height control in the form of knob 318 allows adjustment of the height of the lifting cycle of bar 40 to minimize the lifting cycle time of the apparatus. Knob 318 is connected to a potentiometer (not shown) connected to a control for clutch 244.

The operation of the apparatus of the present invention will be described in conjunction with the block diagram of FIG. 18 illustrating the drive and control systems. Control 320 is includes a circuit to control starting and stopping, direction of rotation and speed of rotation of motor 216. Cutter 34 is in an initial or rest position closest to drive means 50 as shown in FIG. 1. As previously described, the operator draws a section of cloth 30 across track 40 out to an appropriate location along table 10. Then to cut the material the operator simply presses the start button 314 which signals control 320 to start operation of motor 216. The operation of switch 314 also completes a circuit including conductor 54 to operate motor 38 of cutter 34. Clutch 214 is disengaged with gears 230,234 out of mesh and pulley 130 idle. Motor 216 then operates to cause movement of belt 80 to draw cutter 34 along track 40 to cut the cloth 30 as shown in FIG. 1. When cutter 34 reaches its maximum length of travel, as indicated either by limit switch 138 being engaged by cutter 34 or by a preset length determined by the controls 296,298, control 320 causes the direction of motor 216 to reverse thereby reversing the direction of movement of belt 80 and returning cutter 34 to the home or rest position nearest drive means 50 as shown in FIG. 1. The reversal of motor 216 to signals the control associated with clutch 244 cause engagement of clutch 244. This completes a drive between pulley 130 and motor 216 by placing gears 230,234 in meshing engagement. Rotation of pulley 130, in turn, moves belts 110*a*,110*b* to raise track 40 as illustrated in FIGS. 2 and 3. When track 40 reaches the maximum height as determined by control 318, clutch 244 is disengaged and track 40 returns to the position of FIG. 2, the descent thereof being cushioned or controlled by the springs 100. The raising and lowering of track 40 enables the cut sections of cloth 30 to be stacked to the right of track 40 as viewed in FIG. 1. Then the operator simply draws the next section of cloth 30 over track 40 to the predetermined location along table 10 whereupon he presses the start button 314 and the foregoing cycle of operation is completed. This is done for whatever number of times is needed depending upon the work order at hand.

Limit switch 138 provides a maximum limit on the length of travel of cutter 34 across table 10. The cut length controls 296,298 can provide a shorter controlled length of travel. As previously described, when it is desired to sharpen the blade of cutter 34, control 306 is pressed which enables motor 38 of cutter 34 to be operated without operating motor 216 as provided by control 320 as shown in FIG. 18.

Figure 19:
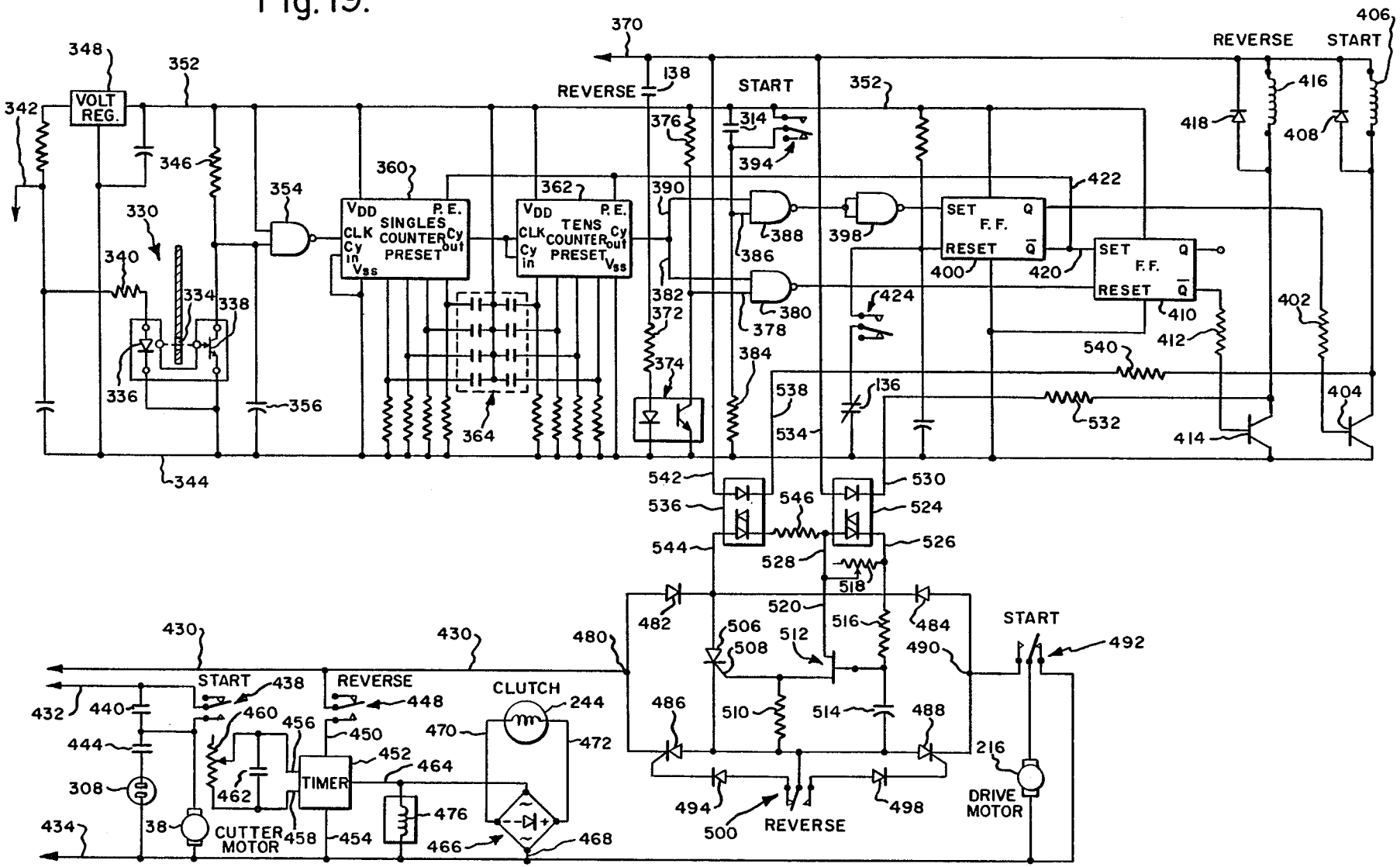
FIG. 19 is a schematic diagram of the control system of the apparatus of the present invention.
Figure 20:
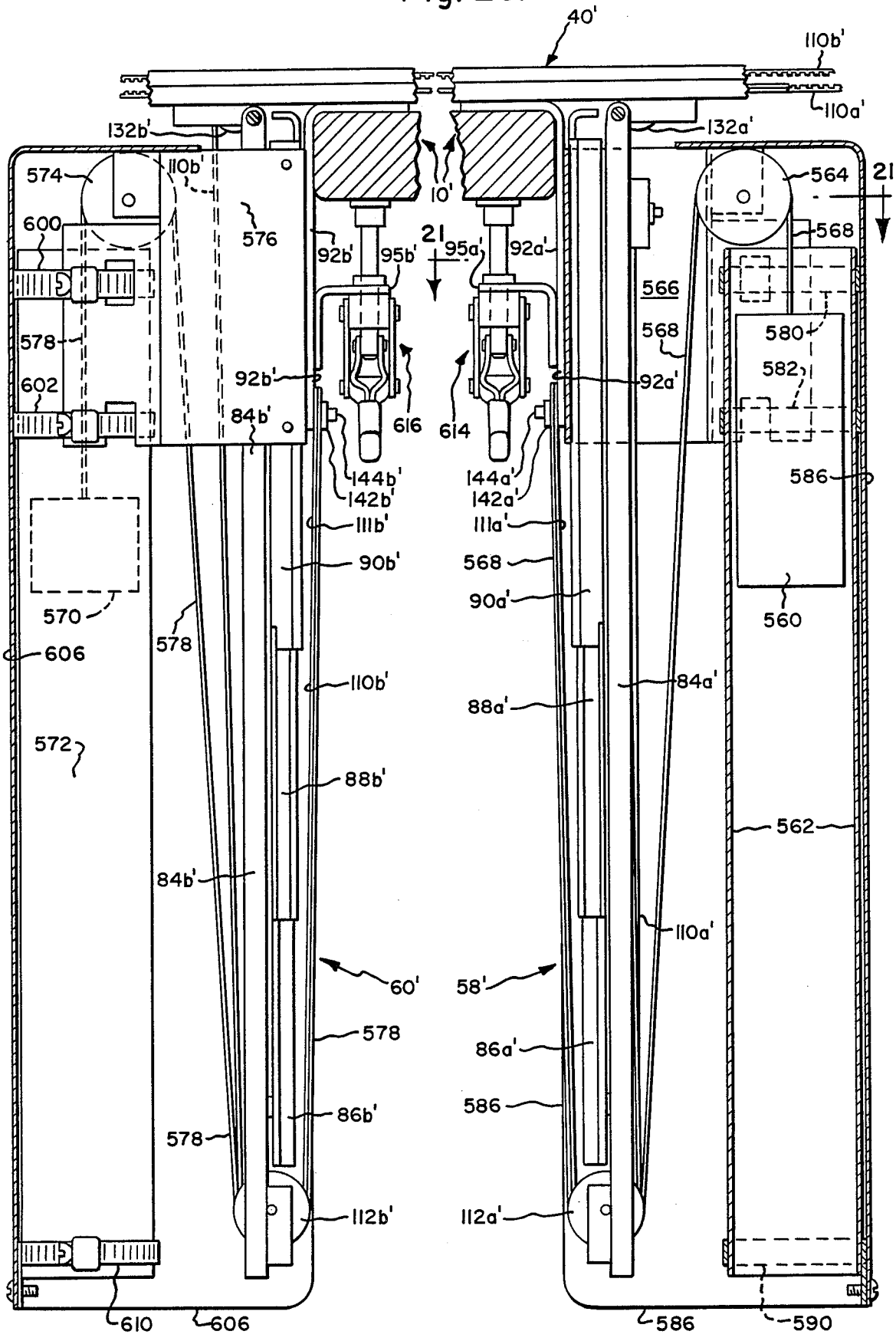
FIG. 20 is a view similar to FIG. 5 illustrating another embodiment of the apparatus of the present invention.

FIG. 19 illustrates in further detail the control system of the present invention. An encoder generally designated 330 comprises a disc 332 connected to the output shaft of motor 216 having an aperture 334 therein and interposed between a light emitting diode 336 and light sensitive transistor 338. The anode of diode 336 is connected through resistor 340 to a source of positive rectified d.c. voltage, on line 342, the cathode of diode 336 and emitter of transistor 338 are connected to a common reference 344, and the collector of transistor 338 is connected through a resistor 346 to the output of a voltage regulator 348 on line 352. During each rotation of the output shaft of motor 216, aperture 334 allows transmission of light from diode 336 to the photosensitive base of transistor 338 thereby producing an output pulse in the transistor collector circuit which is connected to an input of a NAND gate 354, which input also is connected through a capacitor 356 to reference line 344. The other input of gate 354 is connected by line 358 to the regulated voltage on line 352, and the output of gate 354 is connected to the clock input of a singles BCD counter 360, the output of which is connected to the input of a tens BCD counter 362. The preset inputs of counters 360, 362 are connected to a network comprising a plurality of resistors and contacts of a cut length digital switch generally designated 364. Each of the resistors is connected between a corresponding counter input and the common reference 344. Switch 364 functionally represents the dials 292, 294 shown in FIG. 17.

The reverse limit switch 138 is connected from the source of positive rectified d.c. voltage on line 370 through a resistor 372 to the input of a photo transistor generally designated 374. The anode of the diode of photo transistor 374 is connected to resistor 372, the cathode of the diode and the emitter of the transistor are connected to common reference 344, and the collector of the transistor is connected through a resistor 376 to the regulated voltage on line 352. The output of the photo transistor 374 is connected by line 378 to one input of a NAND gate 380, the other input of which is connected by line 382 to the output of counter 362. The start switch 314 is connected from line 352 through a resistor 384 to line 344, and the junction of switch 314 and resistor 384 is connected by line 386 to one input of a NAND gate 388, the other input of which is connected by line 390 to the output of counter 362. The switch contacts generally designated 394 of a remote controlled start relay are connected in parallel with switch 314.

The output of NAND gate 388 is connected to both inputs of a NAND gate 398, the output of which is connected to the set input of a start command flip-flop 400. The true output of flip-flop 400 is connected through a resistor 402 to the base terminal of an NPN transistor switch 404, the collector-emitter path of which is connected in series with the winding 400 of a start relay. Winding 406 is connected to line 370, a protective diode 408 is connected across winding 406 and the emitter of transistor 404 is connected to line 344. Thus, closure of start switch 314 together with the absence of an output from counter 362 causes NAND gate 388 to set flip-flop 400 to provide an output to turn transistor 404 on thereby energizing the start relay winding 406 to cause operation of motor 216 in a forward direction as will be described.

The output of NAND gate 380 is connected to the reset input of a reverse command flip-flop 410, the complement output of which is connected through a resistor 412 to the base terminal of an NPN transistor switch 414, the collector-emitter path of which is connected in series with the winding 416 of a reverse relay. Winding 416 is connected to line 370, a protective diode 418 is connected across winding 416, and the emitter of transistor 414 is connected to line 344. Also, the complement output of counter 400 is connected by line 420 to the set input of flip-flop 410 and by line 422 to the preset enables of counters 360 and 362. Thus, an output from counter 362 plus an open condition of limit switch 138 causes NAND gate 380 to reset flip-flop 410 to provide an output to turn transistor 414 on thereby energizing the reverse relay winding 416 to reverse the operation of motor 216 as will be described.

The normally closed stop limit switch 136 is connected from line 344 through the start relay contacts generally designated 424 to the reset input of flip-flop 400. Contacts 424 are shown in FIG. 19 in a condition prior to energization of winding 406, and when winding 406 is energized and cutter 34 does not engage switch 138, i.e. where it is traveling along track 40, flip-flop 400 is reset to ready it for the next start command.

A. C. power for operating motor 216, clutch 244, and the cutter motor 38 is available on lines 430, 432 and 434. In particular, the a.c. voltage for operating motor 216 is across lines 430, 434 and power on indicator 290 is connected across lines 430, 434. A protective fuse (not shown) can be connected in line 430. Similarly, the a.c. voltage for operating cutter motor 38 is across lines 432, 434 and a protective fuse (not shown) can be connected in line 432. The cutter motor 38 is connected from line 434 through start relay contacts generally designated 438 to line 432 and also through contacts 440 of a sharpened on-off switch to line 432. A sharpener on indicator 308 is connected from line 434 through additional contacts 444 of the sharpener on-off switch and contacts 440 to line 432.

Reverse relay contacts generally designated 448 are connected between line 430 and the input 450 of a timer 452. Another input of timer 452 is connected by line 454 to line 434. The control inputs of timer 452 are connected by lines 456 and 458 to the wiper arm and one terminal, respectively, of a variable resistor 460. A normally open height limit switch 462 is connected across lines 456 and 458. The output of timer 452 is connected by a line 464 to one input of a rectifier 466, the other input of which is connected by line 468 to line 434. The output of rectifier 466 is connected by lines 470, 472 to the winding of clutch 244. The winding 476 of a ply counter is connected between lines 464 and 434.

Power is supplied to motor 216 in the following manner. Line 430 is connected to the input terminal 480 of a full-wave bridge rectifier comprising diode rectifiers 482 and 484 and controlled rectifiers 486 and 488. The output terminal 490 of the bridge rectifier is connected through the start relay contacts generally designated 492 to one terminal of motor 216, the other terminal of which is connected to line 434. Bridge terminal 480 is connected to the anode of diode rectifier 482 and to the cathode of controlled rectifier 486, and bridge terminal 490 is connected to the anode of diode rectifier 484 and to the cathode of controlled rectifier 488. The control terminal of rectifier 486 is connected to the cathode of a diode 496, the control terminal of rectifier 488 is connected to the cathode of a diode 498, and the anodes of diodes 496, 498 are connected to the reverse relay contacts generally designated 500, the switch arm of which is connected by line 502 to the anodes of controlled rectifiers 486, 488. The anode of a controlled rectifier 506 is connected to the cathodes of diodes 482, 484 and the cathode of controlled rectifier 506 is connected to the anodes of controlled rectifiers 486, 488. The gate or control terminal 508 of rectifier 506 is connected through a resistor 510 to the anodes of controlled rectifiers 486, 488 and is connected to the drain terminal of a field effect transistor 512, the gate terminal of which is connected through a capacitor 514 to the anodes of controlled rectifiers 486, 488. The gate terminal of field effect transistor 512 is connected through a resistor 516 to one terminal of a variable resistor 518 serving as a speed control, the wiper arm of which is connected by a line 520 to the source terminal of field effect transistor 512.

The output of a photo-triac 524 is connected by a line 526 to the junction of variable resistor 518 and fixed resistor 516 and by a line 528 to the wiper arm of variable resistor 518. The input of photo-triac 524 is connected by line 530 to one terminal of a resistor 532, the other terminal of which is connected to the collector terminal of transistor 414. Photo-triar 524 also is connected by line 534 to supply voltage line 370. When transistor 414 is turned on to energize reverse relay 416, photo-triac 524 functions to short out the speed control resistor 518 with the result that knife 34 always is returned at the same speed to the home position on track 40 as will be described. Another photo-triac 536 is provided to place the motor control in operation when start relay 406 is energized. The input of photo-triac 536 is connected by line 538 to one terminal of a resistor 540, the other temrinal of which is connected to the collector terminal of transistor 404. Photo-triac 536 also is connected by line 542 to line 370. The output of photo-triac 536 is connected by a line 544 to the junction of rectifiers 482 and 484 and to one terminal of a resistor 546, the other terminal of which is connected through lines 528 and 520 to the source terminal of field effect transistor 512.

Lines 430, 432 and 434 are connected to a source of line a.c. voltage, the two lines 430, 432 being connected together (not shown). Lines 344 and 370 are connected to the outputs of a rectifier (not shown), the inputs of which are connected to the secondary winding of a transformer (not shown) having the primary winding thereof connected to lines 430 and 434. The remote start relay contacts 394 can be operated by a manually operated remote control (not shown) including a rectifier connected to the secondary winding of the afore-mentioned transformer and a relay winding connected to the rectifier output for operating contacts 394.

The control system of FIG. 19 operates in the following manner. When either start switch 34 is closed or the remote control relay energized to move the switch arm to the upper one of the contacts 394 as viewed in FIG. 19, a high level input is applied through line 386 to the input of NAND gate 388. This together with the absence of an input or line 390 causes gate 388 to provide an output which is applied through NAND gate 398 to set flip-flop 400 so that a high signal level is at the true output of flip-flop 400 which turns transistor 404 on to energize start relay winding 406. This, in turn, moves the switch arm to the left-hand one of the contacts 492 to complete the power circuit to motor 216 and moves the switch arm to the lower one of the contacts 438 to complete the power circuit to knife motor 38. As a result, the knife blade 74 is rotated by motor 38 and knife 34 is moved along track 40 in a forward direction by movement of belt 80 driven by motor 216. Accordingly, the sheet of material placed over track 40 is cut.

During the above-described forward travel of knife 34 motor 216 is operated in the forward direction. In this mode the switch arm of reverse relay contacts 500 is in the position shown in FIG. 19. Accordingly, a circuit is completed through diode 496 gating controlled rectifier 486 into conduction, and controlled rectifier 488 is non-conducting. As a result, current flows in the direction from line 434 through motor 216 through diode 484 through controlled rectifier 506 through controlled rectifier 486 to line 430. The magnitude of the current flow is determined by the degree of conduction of rectifier 506 which, in turn, is controlled by the manually adjusted magnitude of resistor 518 which through field effect transistor 512 controls the voltage across resistor 510 and hence the voltage applied to gate terminal 508 of controlled rectifier 506.

Assuming that no length of cut value is entered via switches 364, cutter 34 travels the maximum length along track 40 whereupon it engages reverse limit switch 138 to close the same. Closing of switch 138 causes photo transistor 374 to conduct thereby applying a high level input to NAND gate 380 via line 378. This together with the absence of an output from counter 362 causes NAND gate 380 to reset flip-flop 410 providing a signal at the complement output thereof which turns on transistor 414 to energize reverse relay winding 416 for switching the reverse relay contacts 448 and 500. Alternatively, if it is desired that cutter 34 not travel the maximum length along track 40 the appropriate cut length is entered via switch 364 to the counters 360, 362. As motor 216 rotates to drive belt 80 and move cutter 34 forwardly along track 40, each rotation of motor 216 causes encoder 330 to provide a pulse input to counter 360 as previously described. When the counters 360 and 362 reach a total pulse count corresponding to the desired cut length entered via switch 364, a signal is present at the output of counter 362 which is applied by line 382 to the input of NAND gate 380. This together with the absence of an input on line 378 causes NAND gate 380 to reset flip-flop 410 providing a signal at the complement output thereof which turns on transistor 414 to energize reverse relay winding 416 for switching the reverse relay contacts 448 and 500. Thus, in either case, after maximum forward travel of cutter 34 along track 40 as sensed by limit switch 138 or a shorter distance preset by switch 364 and sensed by encoder 330 and counters 360, 362 relay winding 416 is energized to switch the contacts 448 and 500.

As a result of the foregoing, the switch arm of reverse relay contacts 500 is moved to the right as viewed in FIG. 19 to cause reverse operation of motor 216. In particular, a circuit is completed through diode 498 gating controlled rectifier 488 into conduction and controlled rectifier 486 is non-conducting. Current flows in the direction from line 430 through diode 482 through controlled rectifier 501, through controlled rectifier 488 and through motor 216 to line 434. Accordingly, this is in an opposite direction as compared to the current flow through motor 216 in the forward direction of operation previously described. The turning on of transistor 414 also turns on photo-triac 524 which shorts out speed control resistor 518 causing maximum conduction of controlled rectifier 506 so that cutter 34 is returned along track 40 to the home or initial position at maximum speed after each cutting operation.

Also in response to energization of winding 416, the switch arm of reverse relay contacts 448 is moved to the lower contact as viewed in FIG. 9. As a result, a circuit is completed through timer 352 between lines 430 and 434. This, in turn, results in a voltage substantially equal to that on line 430 to be present on line 464 which is rectified by rectifier 466 and applied to the winding of clutch 244 to energize same to cause lifting of track 40 as previously described. The foregoing continues for a time internal determined by the resistance between timer inputs 456, 458. The latter is determined by either the closing of height limit switch 462 or the setting on lift height control variable resistor 460. In addition, during each raising of track 40 in response to operation of clutch 244, the winding 276 is energized to register a count in the ply counter.

By way of example, in an illustrative apparatus, encoder 330 is type HZ1B2, voltage regulator 348 is type 78MO5, NAND gates 354, 380, 386 and 398 are CD4011BE, counters 360 and 362 are each CD451OBE, flip-flops 400,410 are each CD4013BE, photo transistor 374, is type T1L113, photo triarc 524 and 536 are each MOC3010, controlled rectifiers 486, 488 and 506 are 1S410 and field effect transistor 512 is type 2N2646.

FIGS. 20–25 illustrate apparatus according to another embodiment of the present invention. For convenience in description, those components of this apparatus which are the same as those of the preceeding embodiment are identified by the same reference numeral with a prime designation. The apparatus of this embodiment includes weight means operatively associated with the track raising and lowering means for assisting lowering thereof, in particular for countering the weight of the apparatus during lowering thereof so as to provide a smooth, cushioned descent. There is provided a first weight in the form of a solid cylindrical member 560 of suitable material slidably contained in a tube 562 associated with supporting means 58'. A pulley 564 is rotatably mounted on a bracket 566 fixed to frame **84*a'* at the upper end thereof with pulley 564 being located adjacent the open upper end of the tube 562. A belt or line 568 is fixed at one end to weight 560 and extends upwardly along within tube 562 and is trained around pulley 564 and extends downwardly along the outer side of frame 84*a'* whereupon it is trained around pulley 112*a'*, being superimposed on belt 110*a'*, and extends upwardly along the inner side of frame 84*a'* and is fixed at the end to bracket 92*a'* by a strip 142*a'* and fastener 144*a'* on top of belt end 111*a'*. There is also provided a second weight in the form of a solid cylindrical member 570 of suitable material slidably contained in a tube 572 associated with supporting means 60'. A pulley 574 is rotatably mounted on a bracket 576 fixed to frame 84*b'* at the upper end thereof with pulley 574 being located adjacent the open upper end of tube 572. A belt or line 578 is fixed at one end to weight 570 and extends upwardly along within tube 572 and is trained around pulley 574 and extends downwardly along the outer side of frame 84*b'* whereupon it is trained around pulley 112*b'*, being superimposed on belt 110*b'*, and extends upwardly along the inner side of frame 84*b'* and is fixed at the end to bracket 92*b'* by strip 142*b'* and fastener 144*b'* on top of belt end 111*b'***.

The end of track 40' at which drive means 50' is located is heavier than the opposite end, and therefore the weight near this end, i.e. weight 560, is greater in magnitude than the weight at the opposite end. By way of illustration, in an illustrative apparatus, weight 560 is about three times greater in magnitude than weight 570.

Tube 562 is held at the upper end by a pair of clamps 580,582 which wrap around the tube in the manner of hose clamps and are fastened by suitable means to bracket 566 as shown also in FIG. 21. The arrangement of weight 560, tube 562, pulley 564 and belt 568 is contained within a housing 586 similar to housing 106 of the preceding embodiment but of greater width which housing is secured at the upper end to bracket 566 by fasteners 588 shown in FIG. 21. Tube 562 is held at the lower end by a clamp 590 identical to clamps 580,582 and which is fastened to the lower end of housing 586. Similarly, tube 572 is held at the upper end by a pair of clamps 600,602 which wrap around the tube in the manner of hose clamps and are fastened by suitable means to bracket 576. The arrangement of weight 570, tube 572 pulley 574 and belt 578 is contained within a housing 606 similar to housing 106 of the preceding embodiment but of greater width which housing is secured at the upper end to bracket 576 by fasteners in a manner similar to housing 586. Tube 572 is held at the lower end by a clamp 610 identical to clamps 600,602 and which is fastened to the lower end of housing 606.

The apparatus of this embodiment includes a pair of toggle clamp assemblies generally designated 614 and 616 as alternatives to the adjustment screws **96*a* and 96*b* of the previous embodiment. Each assembly 614 and 616 is mounted in a corresponding one of the flanges 95*a'* and 95*b'* and includes a pivoted handle operating a plunger. Toggle clamps 614,616** can be of the type commercially available under the designation Destaco model 604.

FIG. 22 illustrates diagrammatically the apparatus of this embodiment wherein track 40' is in the lowermost position closest to the top surface 12' of table 10'. As in the previous embodiment this is the normal position of track 40' during rest and during operation and forward travel of the cutter (not shown). In this position, weights 560 and 570 are in the uppermost position near the upper ends of the corresponding tubes 562 and 572, respectively. The diagrammatic view of FIG. 23 shows the apparatus in a raised position wherein track 40', the cutter (not shown) and drive means 50' are elevated relative to table surface 12'. In this position, weights 560 and 570 are in the lowermost position near the lower ends of the corresponding tubes 562 and 572, respectively. When the clutch is disengaged allowing track 40' to return downwardly toward table surface 12' this movement is in opposition to the effect of weights 560,570 which serve to slow or cushion the downward movement of the track 40'.

The apparatus of this embodiment includes an alternative arrangement for applying tension to pulley 130'. As shown in FIG. 25, a belt 620 is wound on one section of pulley 130' in an opposite sense to that of belts **110*a'* and 110*b'*. First and second idler pulleys 622 and 624, respectively, are rotatably mounted in a bracket 626 which is fixed to housing 260' as shown in FIG. 25. Belts 110*a'*,110*b'* upon leaving the corresponding section of pulley 130' are trained around idler 622 and then extend into and along track 40' in the manner of the previous embodiment. Belt 620 upon leaving in the one section of pulley 130' is trained around idler 624 and extends over pin 258' and then extends into and along track 40' to the region of the supporting means and frame adjacent drive means 50'. A pulley 628 is rotatably connected to a bracket 630 mounted to the lower surface of track 40' near frame 84*a'*. Belt 620 is trained around pulley 628 and extends downwardly and is secured at the end thereof to bracket 92*a'* by fastener 632. Thus, when track 40' descends from the elevated position of FIG. 23, belt 620 applied sufficient tension to pulley 130' to insure that belts 110*a'*,110*b'*** *are properly wound back on pulley 130' in readiness for the next lift cycle.*

It is therefore apparent that the present invention accomplishes its intended objects. While embodiments of the present invention have been described in detail, that is for the purpose of illustration, not limitation.

We claim:

1. Apparatus for cutting sheet material such as cloth as said material lies on a supporting surface having opposite sides comprising:

(a) elongated track means adapted to extend across said supporting surface between said sides, said track means having an operative surface over which said sheet material lies during cutting thereof, said track means having a hollow interior;

(b) cutting means operatively associated with said track means for movement in opposite directions along said track for cutting said material;

(c) supporting means on opposite ends of said track means and associated with said opposite sides of said surface, said supporting means including means for raising and lowering said track relative to said supporting surface;

(d) single drive means for moving said cutting means along said track for cutting said material and for raising and lowering said track means;

(e) first coupling means connected to said drive means extending along within the interior of said track and connected to said cutting means;

(f) second coupling means connected to each of said raising and lowering means of each of said supporting means and to said drive means, said coupling means extending along said track means; and (g) control means operatively connected to said drive means for causing said drive means to move said cutting means along said track for cutting said material and thereafter causing said drive means to raise and lower said track means.

2. Apparatus according to claim 1, wherein said track has a slot extending along the length thereof and wherein said cutting means comprises a round knife machine movably supported by said track and having a blade extending into said slot.

3. Apparatus according to claim 1, wherein said first coupling means comprises a toothed belt having ends thereof connected to a portion of said cutting means extending into said interior of said track and trained around idler means at one end of said track and engaging gear means near the opposite end of said track and driven by said drive means.

4. Apparatus according to claim 1 wherein said second coupling means comprises a first belt connected at one end to the raising and lowering means at one end of said track means and trained around pulley means on said supporting means and extending along within said interior of said track means and wound at the other end on pulley means drivenly coupled to said drive means and a second belt connected at one end to the raising and lowering means at the other end of said track means and trained around pulley means on said supporting means and extending along within said interior of said track means and wound at the other end on said driven pulley means.

5. Apparatus according to claim 4, wherein said drive means includes clutch means coupled to said driven pulley means for placing said pulley into and out of a driven condition.

6. Apparatus according to claim 5, wherein said control means includes means for operating said clutch means after cutting of said material so that said clutch means is then operated to place said driven pulley into a driven condition.

7. Apparatus according to claim 1, wherein said drive means includes motor means and clutch means for placing said second coupling means into and out of driven relation to said motor for controlled raising and lowering of said track means.

8. Apparatus according to claim 7, wherein said control means includes means for operating said clutch after cutting said material so that said clutch means is then operated to raise said track.

9. Apparatus according to claim 1, wherein said control means includes means for establishing the maximum length of forward travel of said cutting means along said track means caused by said motive means.

10. Apparatus according to claim 1, wherein said control means includes means for determining the speed of travel of said cutting means along said track means caused by said motive means.

11. Apparatus according to claim 1, wherein said control means includes means for allowing operation of said cutting means without being moved along said track means by said motive means.

12. Apparatus according to claim 1, wherein said control means includes means for establishing the maximum height to which said track means is raised by said motive means.

13. Apparatus according to claim 1, further including weight means operatively associated with said raising and lowering means for assisting lowering thereof.

14. Apparatus for cutting sheet material such as cloth as said material lies on a supporting surface having opposite sides comprising:

(a) elongated track means adapted to extend across said supporting surface between said sides, said track means having an operative surface over which said sheet material lies during cutting thereof;

(b) cutting means operatively associated with said track means for movement in opposite directions along said track for cutting said material;

(c) supporting means on opposite ends of said track means and associated with said opposite sides of said surface, said supporting means including means for raising and lowering said track relative to said supporting surface;

(d) reversible drive motor means;

(e) first coupling means operatively connected to said motor means and to said cutting means for moving said cutting means along said track means in one direction for cutting said material in response to operation of said motor means in one direction and for moving said cutting means along said track in the opposite direction for returning said cutting means in response to operation of said motor means in the opposite direction;

(f) clutch means drivenly coupled to said motor means;

(g) second coupling means operatively coupled to said clutch means and to said means for raising and lowering said track means for raising said track means when said clutch means is engaged; and (h) control means operatively connected to said drive motor means and to said clutch means for controlling operation of said motor means including operation in said one and opposite directions and for controlling engagement and disengagement of said clutch means.

15. Apparatus according to claim 14, wherein said track means includes sensing means for signalling when said cutting means reaches the maximum distance in said one direction and wherein said control means includes circuit means operatively connected to said sensing means for causing said motor means to change operation from said one direction to said forward direction.

16. Apparatus according to claim 15, further including circuit means operatively connected to said sensing means for causing engagement of said clutch means.

17. Apparatus according to claim 14 further including:

(a) means for signalling when said cutting means has traveled a predetermined distance along said track means in said one direction; and (b) circuit means in said control means operatively connected to said signalling means for causing said motor means to change operation from said one direction to said opposite direction.

18. Apparatus according to claim 17 wherein said signalling means comprises:

(a) encoder means operatively associated with said motor means for providing output pulses at constant intervals in response to operation of said motor means; and (b) counter means having an input operatively connected to said encoder means an output connected to said circuit means and additional inputs for receiving information corresponding to said predetermined distance;

(c) whereby when the count of pulses from said encoder means corresponds to the information at said additional inputs thereby indicating that said cutting means has traveled said predetermined distance said counter means provides an output signal to said circuit means.

19. Apparatus according to claim 17, further including circuit means operatively connected to said signalling means for causing engagement of said clutch means.

20. Apparatus according to claim 14, wherein said control means includes means for reversing the direction of operation of said drive motor means in response to a command signal and means for engaging said clutch means in response to reversal of said motor operation.

21. Apparatus according to claim 14, wherein said control means includes means for controlling the speed of operation of said drive motor means.

22. Apparatus according to claim 14, wherein said control means includes means for controlling the height to which said track means is raised.

23. Apparatus according to claim 14, wherein said control means includes means for counting the number of sections of said sheet material cut by said apparatus.

24. Apparatus for cutting sheet material such as cloth as said material lies on a supporting surface having opposite sides comprising:

(a) elongated track means adapted to extend across said supporting surface between said sides, said track means having an operative surface over which said sheet material lies during cutting thereof;

(b) cutting means operatively associated with said track means for movement in opposite directions along said track for cutting said material;

(c) reversible drive motor means;

(d) coupling means operatively connected to said motor means and to said cutting means for moving said cutting means along said track means in one direction for cutting said material in response to operation of said motor means in one direction and for moving said cutting means along said track in the opposite direction for returning said cutting means in response to operation of said motor means in the opposite direction;

(e) control means operatively connected to said drive motor means for controlling operation of said motor means including operation in said one and opposite directions ;

(f) means for signalling when said cutting means has traveled a predetermined distance along said track means in said one direction; and (g) circuit means in said control means and operatively connected to said signalling means for causing said motor means to change operation from said one direction to said opposite direction in response to a signal from said signalling means.

25. Apparatus according to claim 24, wherein said signalling means comprises:

(a) encoder means operatively associated with said motor means for providing output pulses at constant intervals in response to operation of said motor means; and (b) counter means having an input operatively connected to said encoder means an output connected to said circuit means and additional inputs for receiving information corresponding to said predetermined distance.

* * * * *